US009117649B2

(12) United States Patent
Csibi et al.

(10) Patent No.: US 9,117,649 B2
(45) Date of Patent: Aug. 25, 2015

(54) RESISTIVE THIN LAYER HEATING OF FLUORESCENT LAMP

(71) Applicant: General Electric Company, Schenectady, NY (US)

(72) Inventors: Lajos Csibi, Budapest (HU); Laszlo Bankuti, Budapest (HU); Csaba Koronya, Budapest (HU); Janos Kallay, Budapest (HU); Peter Almosdi, Budapest (HU)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 13/710,861

(22) Filed: Dec. 11, 2012

(65) Prior Publication Data

US 2014/0159574 A1 Jun. 12, 2014

(51) Int. Cl.

| | |
|---|---|
| ***H01J 61/35*** | (2006.01) |
| ***H01J 9/20*** | (2006.01) |
| ***H01J 61/04*** | (2006.01) |
| ***H01J 65/04*** | (2006.01) |
| ***H01J 61/56*** | (2006.01) |
| ***H01J 61/28*** | (2006.01) |
| ***H01J 61/52*** | (2006.01) |
| ***H01J 61/54*** | (2006.01) |
| *H01J 19/36* | (2006.01) |

(52) U.S. Cl.

CPC ..... *H01J 61/28* (2013.01); *H01J 61/35* (2013.01); *H01J 61/523* (2013.01); *H01J 61/54* (2013.01); *H01J 19/36* (2013.01)

(58) Field of Classification Search

CPC ..... H01J 61/35; H01J 9/20; H01J 61/04; H01J 65/04; H01J 61/56

USPC ..... 315/50, 51, 32, 46, 49, 112, 94, 108; 313/609, 611

See application file for complete search history.

(56) References Cited

U.S. PATENT DOCUMENTS

| | | | | |
|---|---|---|---|---|
| 5,438,235 | A | 8/1995 | Sommerer et al. | |
| 5,808,414 | A | 9/1998 | Wharmby et al. | |
| 6,064,155 | A * | 5/2000 | Maya et al. | 315/56 |
| 6,114,809 | A | 9/2000 | Winsor | |
| 7,511,431 | B2 * | 3/2009 | Lesch et al. | 315/56 |
| 7,550,925 | B2 | 6/2009 | Lesch et al. | |
| 7,928,644 | B1 * | 4/2011 | Tokes et al. | 313/493 |

(Continued)

FOREIGN PATENT DOCUMENTS

| | | |
|---|---|---|
| CA | 2144260 | 9/1995 |
| EP | 0673057 | 9/1995 |

(Continued)

OTHER PUBLICATIONS

European Search Report and Opinion issued in connection with corresponding EP Application No. 13195793.8 on Jan. 14, 2015.

*Primary Examiner* — Dylan White

(74) *Attorney, Agent, or Firm* — GE Global Patent Operation; Peter T. DiMauro

(57) ABSTRACT

Fluorescent lamps, along with their methods of manufacture and use, are provided. The fluorescent lamp can include a discharge tube extending from a first end to a second end; a resistive transparent coating (e.g., a tin oxide thin film layer, such as a fluor-doped tin oxide thin film layer) on the outer surface of the discharge tube; and a pair of electric terminals positioned on the discharge tube such that a first terminal is on the first end and a second terminal is on the second end.

15 Claims, 4 Drawing Sheets

(56) References Cited

U.S. PATENT DOCUMENTS

| | | | | |
|---|---|---|---|---|
| 7,969,074 | B2 | 6/2011 | Stockwald et al. | |
| 2005/0035700 | A1* | 2/2005 | Yano et al. | 313/234 |
| 2006/0226781 | A1 | 10/2006 | Allen et al. | |
| 2011/0012509 | A1 | 1/2011 | Wursching et al. | |
| 2011/0089832 | A1* | 4/2011 | Kelly | 315/56 |
| 2011/0234094 | A1 | 9/2011 | Wursching et al. | |
| 2012/0019136 | A1 | 1/2012 | Wursching et al. | |
| 2013/0221849 | A1* | 8/2013 | Koronya et al. | 315/116 |

FOREIGN PATENT DOCUMENTS

| | | | | | |
|---|---|---|---|---|---|
| EP | 0767340 | A2 | | 4/1997 | |
| EP | 2597936 | A1 | | 5/2013 | |
| WO | 2008029369 | | | 3/2008 | |
| WO | WO 2008/029369 | | * | 3/2008 | H01J 61/35 |

* cited by examiner

RESISTIVE THIN LAYER HEATING OF FLUORESCENT LAMP

FIELD OF THE INVENTION

Embodiments of the present invention generally involve lighting or lamp assemblies and more particularly to a fluorescent lamp (FL) or lamp assembly having improved run-up properties.

BACKGROUND OF THE INVENTION

The majority of the known and commercially available low-pressure fluorescent discharge lamps are so-called fluorescent lamps (FLs) at present. For example, compact fluorescent lamps (CFLs) are intended to replace incandescent lamps used in a wide field of industry and home applications. In order to provide a CFL that resembles conventional incandescent lamps, a bulb shaped outer envelope may encapsulate the CFLs. The advantages of these lamps are low power consumption and long lifetime. However, one of the main disadvantages of FLs, including CFLs, is their relatively long run-up time.

A number of different solutions currently exist to improve run-up behavior, i.e., the time needed after switching on the supply for the lamp to reach 80% of its stabilized luminous flux (as defined by Energy Star Program Requirements for Compact Fluorescent Lamps 4.3: Section 2, Definition DD, Page 2). This property is also referred to as "lamp warm-up time," which is the time needed after start-up to emit a defined proportion of its stabilized luminous flux (defined by the Commission Regulation (EC) EuP No 244/2009 Annex 1/1/k). By way of example only, long-life fluorescent lamps currently need approximately 0.5 to 1.5 seconds to preheat the cathodes or electrodes before starting. Before preheating is complete, there is no light emission from the lamp. Once the arc discharge is initiated, the fluorescent lamp still requires an additional approximately 20 to 120 seconds or more to reach 80% of its stabilized luminous flux.

Prior attempts to reduce the run-up time of a FL that uses amalgam mercury dosing by incorporating an auxiliary amalgam close to one of the electrodes in the lamp. As a result of this arrangement, mercury stored in the auxiliary amalgam is vaporized shortly after switching on and in this way, the run-up period is reduced. However, one disadvantage of this proposed solution is that it does not provide an instant light feature.

Another known solution combines two lamps in one unit. More particularly, a fluorescent lamp and a conventional incandescent lamp are combined. Although it has been suggested to simultaneously turn on both lamps in order to result in instant light from the incandescent lamp, and then subsequently terminate or switch off the incandescent lamp, these known arrangements do not provide an efficient and effective manner for warming up the mercury source. For example, it has been suggested that a thermally sensitive element be located in the ballast compartment. This arrangement does not provide an accurate assessment of the actual thermal conditions of the discharge vessel. Further, locating a thermally sensitive element in a ballast compartment is potentially impacted by temperature variations caused by different illumination positions of the lamp e.g. vertically upright or inverted. As a result, the thermally sensitive element does not provide an accurate representation of the heat conditions.

Still another known solution is to apply power to the incandescent lamp only when the lamp assembly is turned on or switched on. Once a predetermined temperature is reached, the switch then de-energizes the incandescent lamp and subsequently applies power to the fluorescent lamp. The thermal switch associated with this arrangement aids in starting of the fluorescent lamp in low temperature, ambient conditions; however, it does not improve run-up of the lamp assembly.

In still another known arrangement, a fluorescent lamp is used in conjunction with a small incandescent lamp and AC power line voltage is provided. An inverter-type ballast is combined with the lamp base and is operable to power the fluorescent lamp whenever the base is received in the associated lamp socket. A thyristor or silicon controller rectifier (SCR) causes total light provided from the combination fluorescent-incandescent lamp assembly to remain substantially constant from the moment that AC power line voltage is provided at the lamp socket. When the AC power line voltage is initially provided, light from the incandescent lamp is at its maximum, while light provided from the fluorescent lamp will be at a minimum. Thereafter, light from the incandescent lamp will gradually diminish as the fluorescent lamp gradually increases. After a period, the AC power line voltage is totally disconnected from the incandescent lamp. Unfortunately, due to the SCR, the RMS value of the input power is about 70% of the nominal value and results in a specialized incandescent lamp that has increased cost and complexity.

Consequently, a need exists for a long-life fluorescent lamp that provides energy savings with instant light capabilities and fast warm-up, and overcomes the problems noted with prior proposed solutions.

BRIEF DESCRIPTION OF THE INVENTION

Aspects and advantages of the invention are set forth below in the following description or may be learned through practice of the invention.

Fluorescent lamps having a number of advantages over known FLs are generally provided, along with their methods of manufacture and use. In one embodiment, the fluorescent lamp includes a discharge tube extending from a first end to a second end; a resistive transparent coating (e.g., a tin oxide thin film layer, such as a fluor-doped tin oxide thin film layer) on the outer surface of the discharge tube; and a pair of electric terminals positioned on the discharge tube such that a first terminal is on the first end and a second terminal is on the second end. The resistive transparent coating has, in one embodiment, a thickness of about 1.2 μm or less.

The resistive transparent coating can, in certain embodiments, have a resistivity of about 10 ohms to about 10,000 ohms. The resistive transparent coating, in one embodiment, can have a variable resistivity such that a middle area of the resistive transparent coating has a greater resistivity than an area of the resistive transparent coating at the first end and/or the second end.

The resistive transparent coating can be electrically connected to the pair of electric terminals. For example, the lamp can further include a first electrical connection from the first electric terminal to the resistive transparent coating on the first end of the discharge tube; and a second electrical connection from the second electric terminal to the resistive transparent coating on the second end of the discharge tube.

In one particular embodiment, the lamp can further include a lamp driver electrically connected to a discharge driver and a heating driver. The discharge driver can be electrically connected to the first electrode and the heating driver is electrically connected to the resistive transparent coating on the first end of the discharge tube. The heating driver can be configured to provide about 1 watt to 1000 watts to the resistive transparent coating. In certain embodiments, the heating driver is connected to a controller (e.g., a timer), which can be configured to provide current to the resistive transparent coating for a run-up period upon the fluorescent lamp being turned on by measuring time, temperature, light output or electrical parameters.

A transparent insulating layer can be positioned on the resistive transparent layer in particular embodiments.

Methods are also generally provided for forming a fluorescent lamp. In one embodiment, the resistive transparent layer can be deposited onto an outer surface of a discharge tube (e.g., via chemical vapor deposition); and electrodes can be attached to a first end and a second end of the discharge tube.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

This detailed description uses numerical and letter designations to refer to features in the drawings. Like or similar designations in the drawings and description have been used to refer to like or similar parts of embodiments of the invention.

DETAILED DESCRIPTION OF THE INVENTION

Reference will now be made in detail to present embodiments of the invention, one or more examples of which are illustrated in the accompanying drawings.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
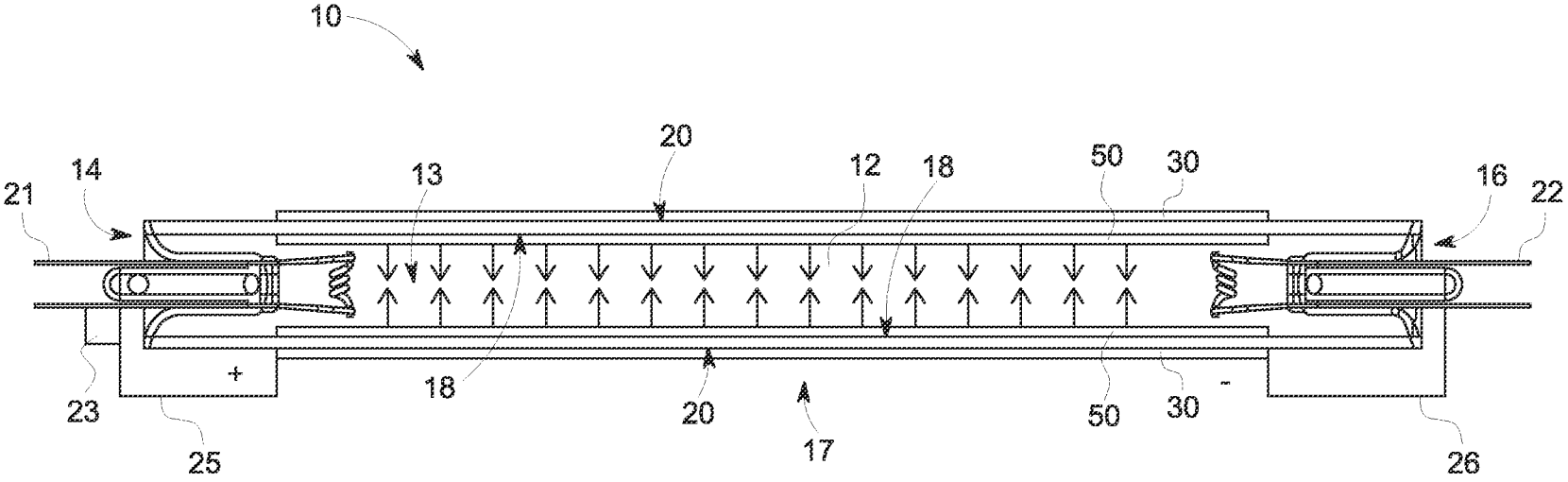
FIG. 1 shows a schematic cross-sectional view of an exemplary embodiment of a FL that includes a thin resistive coating layer for heating the tube to decrease run-up time.

Fluorescent lamps (FLs) having improved properties, including compact fluorescent lamps, are generally provided, along with their methods of manufacture. Referring to FIG. 1, an exemplary fluorescent lamp 10 is shown including a discharge tube 12 extending from a first end 14 to a second end 16. The discharge tube 12 defines an inner surface 18 and an outer surface 20. Oppositely positioned electrodes 21, 22 are positioned on the discharge tube 12 such that a first electrode 21 is on the first end 14 and a second electrode 22 is on the second end 16. In the shown embodiment, a phosphor coating 50 is layered on the inner surface 18 of the discharge tube 12 to achieve lighting in the desired wavelengths.

A resistive transparent coating 30 is shown layered on the outer surface 20 of the discharge tube 12. Generally, one particular aspect of the present invention provides that the resistive transparent coating 30 is electrically connected to a pair of heating electrodes 25, 26 to apply a current to the resistive transparent coating 30, which in turn creates an electrical heating affect. This external heating of the discharge tube 12 can increase the rate at which mercury evaporates within the inner cavity 13 during lamp start, thereby reducing the time needed for the lamp to reach maximum lumen output.

In one embodiment, the pair of heating electrodes 25, 26 is electrically connected to the first electrode 21 and the second electrode 22, respectively. For example, a first electrical connection 25 can be present from the first electrode 21 to the resistive transparent coating 30 on the first end 14 of the discharge tube 12, and a second electrical connection 26 can be present from the second electrode 22 to the resistive transparent coating 30 on the second end 16 of the discharge tube 12. For instance, a pair of galvanic contacts can be utilized as the electrical connections 25, 26 through attachment to the resistive transparent coating 30 and to the first electrode 21 and second electrode 22, respectively.

FIG. 1 shows a lamp driver 23 electrically connected to both the first electrode 21 at the first end 14 of the discharge tube 12 and to the second electrode 22 at the second end 16 of the discharge tube 12 to close the circuit. A second heating electrode 26 is shown electrically connecting the second electrode 22 to the resistive transparent coating 30 to complete the circuit.

Figure 5:
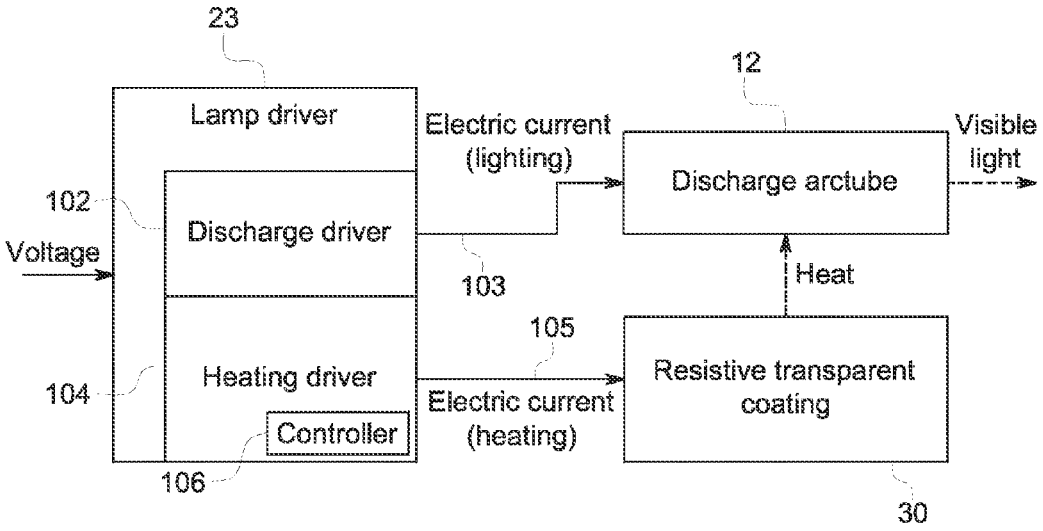
FIG. 5 shows a schematic of an exemplary electric circuit for use with a FL that includes a thin resistive coating layer.

Turning to FIG. 5, the lamp driver 23 of FIG. 1 is schematically illustrated. The lamp driver 23 is electrically connected to a discharge driver 102 and a heating driver 104. The discharge driver 102 is configured to provide current to the discharge tube 12 through the electrical connection 103 to provide electric current for lighting purposes (e.g., via the first electrode 21 at the first end 14 of the discharge tube 12). The heating driver 104 is electrically connected to the resistive transparent coating 30 through the electrical connection 105 to provide electric current for heating purposes (e.g., via the first heating electrode 25). The heating driver 104 can be configured to provide, in one embodiment, about 1 watt to about 1000 watts to the resistive transparent coating 30 (e.g., about 10 watts to about 100 watts).

The heating driver 104 can also include a controller 106 configured to provide current to the resistive transparent coating 30 for a run-up period following the fluorescent lamp 10 being turned. The controller can include any suitable sensor or combination of sensors that are configured to measure time, temperature, light output, and/or electrical parameters, such as voltage, current, and/or power of the lamp 10 or the discharge driver 102. After this run-up period, the controller 106 can then break the electrical connection within the heating driver 104 such that no electrical current is passed through the resistant transparent coating 30. Generally, the controller 106 can be tuned for each particular lamp 10 to provide sufficient warm-up heating to the discharge tube 12, particularly in the areas away from the ends 14, 16, to allow for quickly reaching full lumens. For instance, the run-up period can be about 5 seconds to about 1 minute. In one embodiment, the controller can include a simple timer configured to provide current to the resistive transparent coating 30 for a run-up period upon the fluorescent lamp 10 being turned on.

According to certain aspects of the present invention, the resistive transparent coating 30 includes a material that is generally resistive in nature, while remaining substantially transparent to light within the visible wavelengths (e.g., about 380 nm to about 780 nm). For example, the resistive transparent coating 30 can have at least about 65% transparent in the UV wavelengths (e.g., about 10 nm to about 400 nm), the visible wavelengths (e.g., about 380 nm to about 750 nm), and/or the near IR wavelengths (e.g., about 750 nm to about 0.1 mm) of light. In one embodiment, the resistive transparent coating 30 can be a thin film layer.

According to certain aspects of the present invention, the transparency of the resistive transparent coating 30 can be controlled as desired, depending on the end use of the lamp 10. For example, the resistive transparent coating 30 can be configured to be about 65% transparent or greater (e.g., about 85% or greater) in a particular range of wavelength, such as in the near IR wavelengths, the visible wavelengths, and/or the UV wavelengths.

The resistance of the resistive transparent coating 30 can be adjusted to the electronic driver by changing the deposition parameters and/or the chemical composition of the precursor material. In certain embodiments, the resistive transparent coating 30 can have a resistivity of about 10 ohms to about 10,000 ohms. In one embodiment, the resistivity of the resistive transparent coating 30 can vary across the surface area defined by the resistive transparent coating 30.

Figure 4:
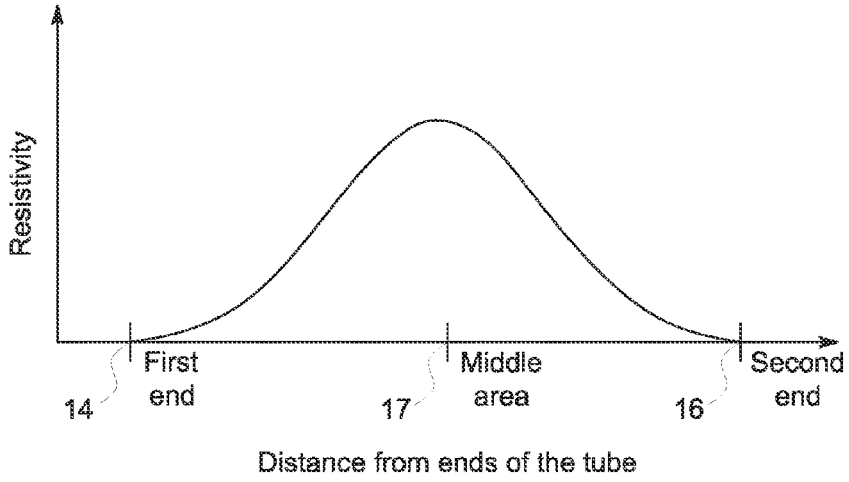
FIG. 4 shows a plot of the resistivity of the thin resistive coating layer vs. distance from an end of the tube.

FIG. 4 shows a plot of the resistivity of the thin resistive coating layer vs. distance from an end of the tube. In the particular embodiment shown by FIG. 4, the resistance of the resistive transparent coating 30 increases as a function of distance from the ends (i.e., the first end 14 and/or the second end 16) toward the middle area 17 of the discharge tube 12. As such, more heat can be generated by the resistive transparent coating 30 in the areas away from the ends 14, 16 (e.g., in the middle area 17), than in the areas near the ends 14, 16, since the middle areas 17 are generally the colder part of the FL 10 prior to heating. Thus, in such an embodiment, the additional heat generated by the resistive transparent coating 30 in the middle areas 17 can allow for an shortened warm-up time prior to the lamp 10 reaching at least about 80% of its stabilized luminous flux. For example, the resistance of the resistive transparent coating 30 in the middle area 17 can be at least about twice as much as the resistance at the first end 14 and/or the second end 16 (e.g., at least about 3 times as much).

In one embodiment, the resistive transparent coating 30 can include a tin oxide. In certain other embodiments, the resistive transparent coating 30 can further include another element (e.g., be doped with) to adjust the resistivity as desired, including but not limited to fluorine (i.e., a fluor-doped tin oxide), an indium tin oxide, a zinc tin oxide, or the like, or mixtures thereof. In one embodiment, the weight ratio of tin to the dopant (e.g., fluorine) can be about 1:1 to about 30:1. For instance, the dopant material can be present in an amount sufficient to control the resistivity of the resistive transparent coating 30, such as up about 30% wt. by weight dopant to the weight of tin.

The resistive transparent coating 30 can generally be deposited by any suitable deposition method, including but not limited to chemical vapor deposition, sputtering, sublimation, evaporation, spray pyrolysis, etc. For instance, in one embodiment, the resistive transparent coating 30 can be deposited via chemical vapor deposition onto a heated discharge tube 12. The resistive transparent coating 30 can generally define a thin film, which can, in certain embodiments, have a thickness of about 1.2 μm or less (e.g., about 100 nm to about 1.1 μm). The resistive transparent coating 30 can be a single layer or may be formed from a plurality of layers.

Figure 2:
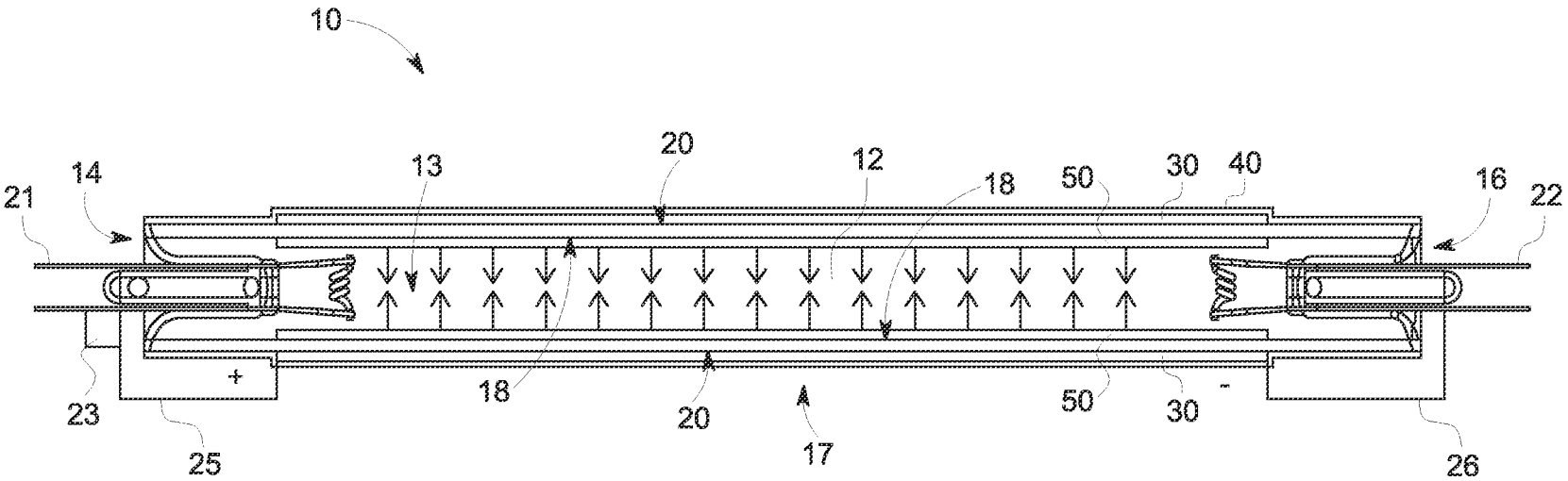
FIG. 2 shows a schematic cross-sectional view of an exemplary embodiment of a fluorescent lamp that includes a transparent insulating layer over the thin resistive coating layer as shown in FIG. 1.

FIG. 2 shows an embodiment of a fluorescent lamp 10 that further includes a transparent insulating layer 40 on the resistive transparent layer 30. The transparent insulating layer 40 can protect the user of the lamp 10 from coming into contact with the resistive transparent layer 30 during the time the heating current is applied, in order to inhibit electrical shock. Additionally, the transparent insulating layer 40 can prevent hazards from glass fractures in case of abnormal mechanical trauma occurring to the lamp 10. The transparent insulating layer 40 can be constructed from, for example, a heat resistant organic varnish (e.g., a polyester, a polyolefin, a polyurethane, etc., or copolymers or mixtures thereof), transparent polytetrafluoroethylene (e.g., Teflon® available from E. I. du Pont de Nemours and Company, Wilmington, Del.), and the like.

Figure 3:
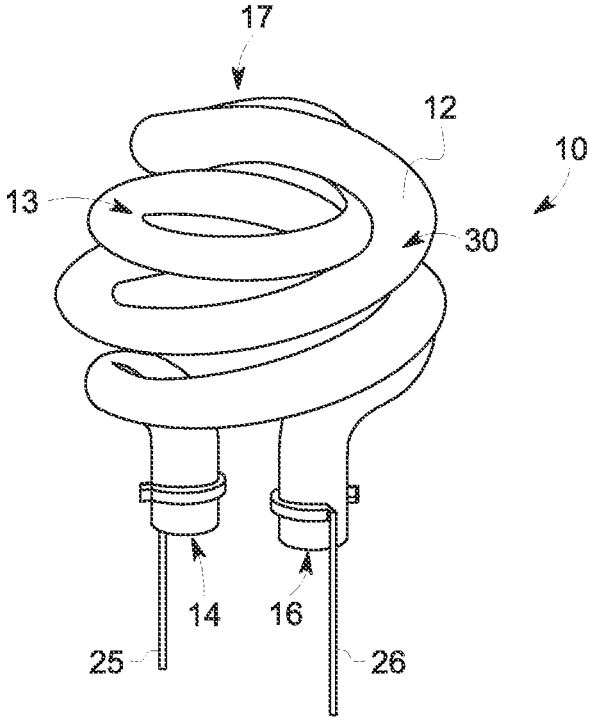
FIG. 3 shows a perspective view of one exemplary FL, such as shown in FIG. 1 or 2.

Although shown as having a tubular shape in FIGS. 1 and 2, it is to be understood that the discharge tube 12 can be shaped as desired. For example, FIG. 3 shows a spiraled tube 12 configuration. Other tube shapes, such as folded, etc., can be utilized as desired.

In the present disclosure, when a layer is being described as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed:

1. A low pressure fluorescent lamp comprising:

a discharge tube extending from a first end to a second end, wherein the discharge tube defines an inner surface and an outer surface;

a phosphor coating on the inner surface of the discharge tube;

a resistive transparent coating on the outer surface of the discharge tube, wherein the resistive transparent coating has a resistivity of about 10 ohms to about 10,000 ohms; and a pair of electric terminals positioned on the discharge tube such that a first terminal is on the first end and a second terminal is on the second end;

the lamp further comprising a lamp driver electrically connected to a discharge driver and a heating driver, wherein the discharge driver is electrically connected to the first electrode and the heating driver is electrically connected to the resistive transparent coating on the first end of the discharge tube.

2. The fluorescent lamp as in claim 1, wherein the resistive transparent coating has a variable resistivity such that a middle area of the resistive transparent coating has a greater resistivity than an area of the resistive transparent coating located along at least one of the first end and the second end.

3. The fluorescent lamp as in claim 1, wherein the resistive transparent coating is electrically connected to the pair of electric terminals.

4. The fluorescent lamp as in claim 1, wherein the resistive transparent coating comprises a tin oxide.

5. The fluorescent lamp as in claim 4, wherein the resistive transparent coating comprises a tin oxide doped with fluorine.

6. The fluorescent lamp as in claim 1, wherein the resistive transparent coating has a thickness of about 1.2 μm or less.

7. The fluorescent lamp as in claim 1, further comprising:

a first electrical connection from the first electric terminal to the resistive transparent coating on the first end of the discharge tube; and a second electrical connection from the second electric terminal to the resistive transparent coating on the second end of the discharge tube.

8. The fluorescent lamp as in claim 1, wherein the heating driver is configured to provide about 1 watt to 1000 watts to the resistive transparent coating.

9. The fluorescent lamp as in claim 1, wherein the heating driver is connected to a controller.

10. The fluorescent lamp as in claim 9, wherein the controller is configured to provide current to the resistive transparent coating for a desired run-up period.

11. The fluorescent lamp as in claim 10, wherein current is provided by the controller upon the fluorescent lamp being turned on until a desired measurement is achieved in at least one of time, temperature, light output, and electrical parameters.

12. The fluorescent lamp as in claim 1, wherein the heating driver is connected to a timer.

13. The fluorescent lamp as in claim 1, further comprising:

a transparent insulating layer on the resistive transparent layer.

14. A fluorescent lamp comprising:

a discharge tube extending from a first end to a second end, wherein the discharge tube defines an inner surface and an outer surface;

a resistive transparent coating on the outer surface of the discharge tube, wherein the resistive transparent coating has a thickness of about 1.2 μm or less; and a pair of electric terminals positioned on the discharge tube such that a first terminal is on the first end and a second terminal is on the second end.

15. A low pressure fluorescent lamp comprising:

a discharge tube extending from a first end to a second end, wherein the discharge tube defines an inner surface and an outer surface;

a phosphor coating on the inner surface of the discharge tube;

a resistive transparent coating on the outer surface of the discharge tube, wherein the resistive transparent coating has a variable resistivity such that a middle area of the resistive transparent coating has a greater resistivity than an area of the resistive transparent coating located along at least one of the first end and the second end; and a pair of electric terminals positioned on the discharge tube such that a first terminal is on the first end and a second terminal is on the second end.

* * * * *